US005279444A

United States Patent [19]

Williams

[11] Patent Number: 5,279,444

[45] Date of Patent: * Jan. 18, 1994

[54] PROCESS FOR TREATING A GARBAGE DISPOSAL

[75] Inventor: Keith E. Williams, Rochester, N.Y.

[73] Assignee: Htiek Company, Inc., Rochester, N.Y.

[ * ] Notice: The portion of the term of this patent subsequent to May 11, 2010 has been disclaimed.

[21] Appl. No.: 822,187

[22] Filed: Jan. 16, 1992

Related U.S. Application Data

[63] Continuation-in-part of Ser. No. 780,272, Oct. 15, 1991, Pat. No. 5,209,380.

[51] Int. Cl.[5] ..... B65D 83/00

[52] U.S. Cl. ..... 222/1; 222/402.13; 4/222; 134/22.12; 134/24

[58] Field of Search ..... 222/402.13, 1; 141/367; 4/222, DIG. 9; 134/22.12, 22.14, 24

[56] References Cited

U.S. PATENT DOCUMENTS

| | | | |
|---|---|---|---|
| 3,156,382 | 11/1964 | Michell | 222/402.13 X |
| 3,404,814 | 10/1968 | Wakeman | 222/402.13 |
| 3,744,678 | 7/1973 | Beres et al. | 222/402.13 X |
| 3,823,427 | 7/1974 | Pittet | 134/22.12 X |
| 4,034,427 | 7/1977 | Breznock et al. | 222/402.13 X |
| 4,277,004 | 7/1981 | Barlics | 222/402.13 X |
| 4,910,808 | 3/1990 | Roth | 4/222 |

FOREIGN PATENT DOCUMENTS

| | | | |
|---|---|---|---|
| 2405875 | 6/1979 | France | 222/402.13 |
| 2504097 | 10/1982 | France | 222/402.13 |
| 2031525 | 4/1980 | United Kingdom | 222/402.13 |
| 2181489 | 4/1987 | United Kingdom | 222/402.13 |
| 2238580 | 6/1991 | United Kingdom | 222/402.13 |

*Primary Examiner*—Andres Kashnikow
*Assistant Examiner*—Anthoula Pomrening
*Attorney, Agent, or Firm*—Howard J. Greenwald

[57] ABSTRACT

A process for treating a garbage disposal unit by spraying material into its inlet is disclosed. The process utilizes a specified device, which contains an aerosol propellant container and a substantially cylindrical adaptor The adaptor is integrally formed, with both an upwardly-extending lip section and a downwardly-extending bottom section. The upwardly-extending lip section contains at least three flange portions separated by slots in which movable tabs are disposed. The downwardly-extending bottom section contains an orifice.

7 Claims, 4 Drawing Sheets

PROCESS FOR TREATING A GARBAGE DISPOSAL

CROSS-REFERENCE TO RELATED PATENT APPLICATION

This is a continuation-in-part of applicant's copending patent application 07/780,272, filed on Oct. 15, 1991, now U.S. Pat. No. 5,209,380.

FIELD OF THE INVENTION

A process for treating a garbage disposal which utilizes a device which is comprised of an aerosol container comprising foam material, and means for dispensing said material when the aerosol container is placed within the opening of the garbage disposal.

BACKGROUND OF THE INVENTION

Compositions for masking and removing unpleasant odors are well known to those skilled in the art. Thus, by way of illustration, such compositions are described in U.S. Pat. No. 4,755,377 of Steer (which discloses an aqueous-based gel air-treating composition comprised of a gel base and a gaseous component), U.S. Pat. No. 4,009,253 of Schleppnik et al. (which discloses that compositions comprised of 4-cyclohexyl-4-methyl-2-pentanone counteract malodors), U.S. Pat. No. 4,622,221 of Schleppnik (which discloses that a specified cyclohexyl compound is a malodor counteractant), and the like. The disclosure of each of the aforementioned patents is hereby incorporated by reference into this specification.

As is well known, garbage disposal units are fertile sources of malodors. Means of combating such malodors in garbage disposal units have been suggested. Thus, for example, in U.S. Pat. No. 4,852,813, Douglas C. Brackett teaches a device which, in response to the activation of the garbage disposal unit, is propelled against a wall of an interior chamber of the unit. The device of this patent is not very effective and, despite the fact that it has been commercially available for several years, has met with a marked degree of commercial failure.

It is an object of this invention to provide a garbage disposal cleaning device which can readily, effectively, and inexpensively both clean, disinfect, and deodorize garbage disposals.

It is another object of this invention to provide a garbage disposal cleaning device which contains means for being actuated only when it is in a specified position within an opening of the garbage disposal and a specified amount of force is applied.

SUMMARY OF THE INVENTION

In accordance with this invention, there is provided a process for treating a garbage disposal unit which utilizes a specified device. This device contains an aerosol container which is preferably comprised of foam material containing disinfectant, deodorizing agent, and cleaning agent. The aerosol container is removably attached to an adaptor which, after the device has been placed within the opening of the garbage disposal and pressure has been applied to the adaptor, will cause foam material to flow from the aerosol container into the garbage disposal.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
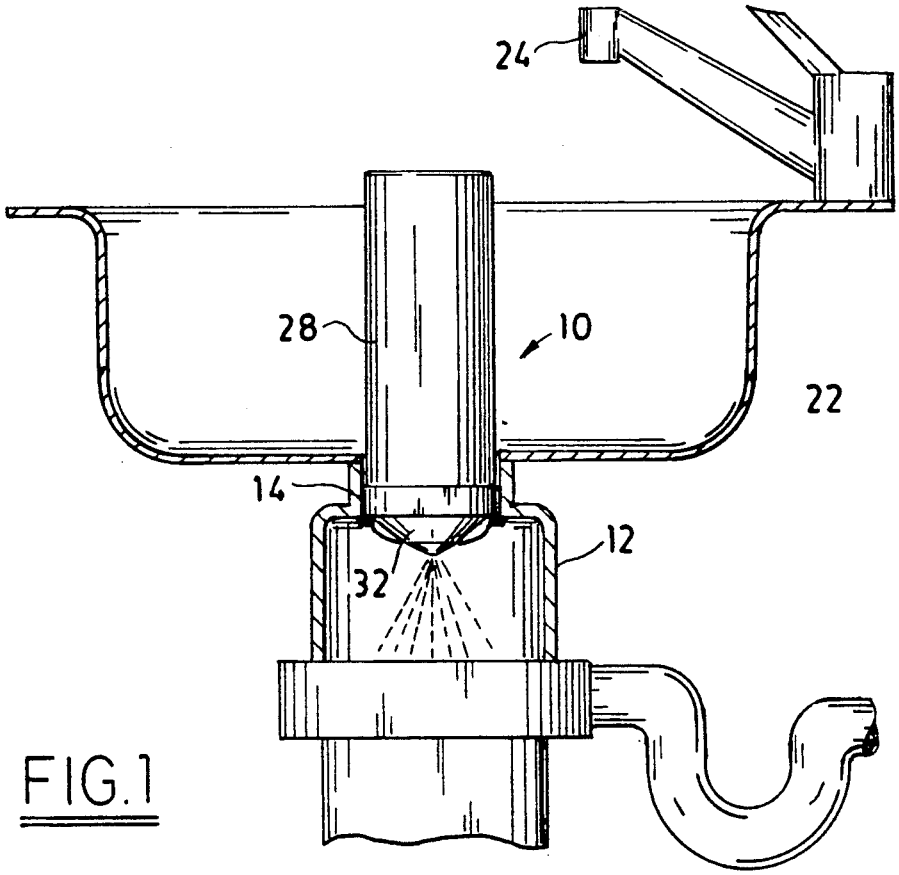
FIG. 1 is a sectional view illustrating the cleaning device of this invention disposed within the opening of a garbage disposal unit.

FIG. 1 illustrates a preferred embodiment of the device 10 which may be used in the process of this invention, wherein said cleaning device 10 is disposed within garbage disposal 12.

Cleaning device 10 may be used in any conventional garbage disposal unit. As is known to those skilled in the art, such garbage disposal units generally contain an interior chamber defined by a surrounding wall and a rotatable grinder assembly located within the chamber.

Figure 3:
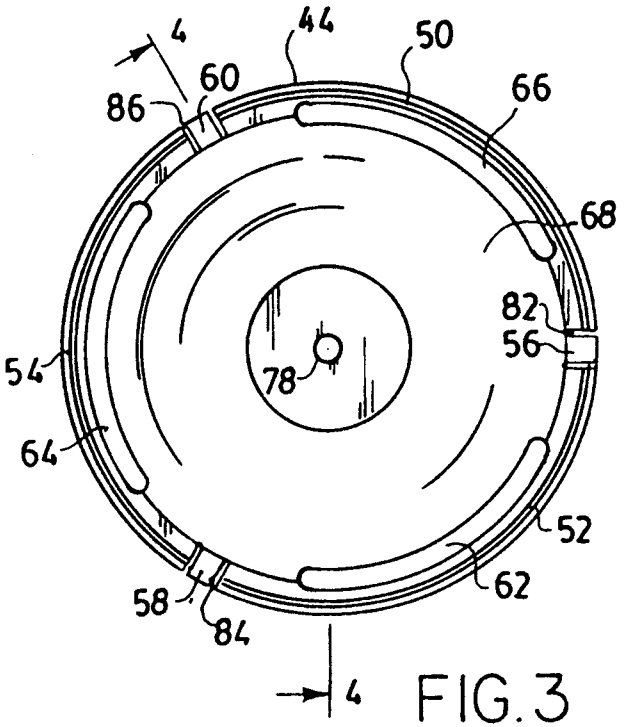
FIG. 3 is a bottom view of the adaptor of FIG. 2.
Figure 4:
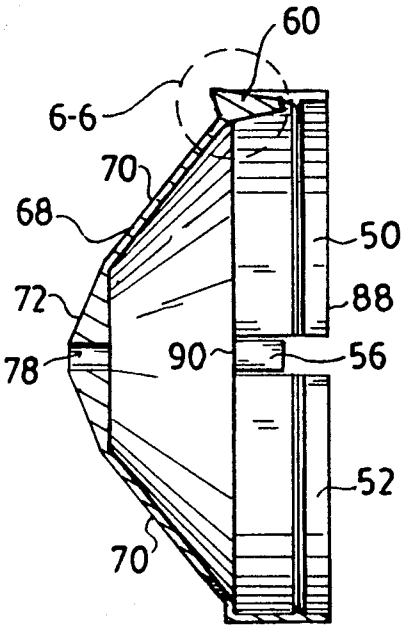
FIG. 4 is a side view of the adaptor of FIG. 2.

One such garbage disposal unit is illustrated in U.S. Pat. No. 4,852,813 of Brackett, the disclosure of which is hereby incorporated by reference into this specification. Referring to FIG. 3 of the Brackett patent, it will be seen that conventional garbage disposal unit 14 is located below a sink 16, which includes a faucet. The sink 16 has a drain 18 which serves as an inlet to the garbage disposal unit 14. More particularly, the drain 18 communicates directly with an interior chamber 20 of the garbage disposal unit 14, the chamber 20 being defined by a cylindrical wall 22. A drain pipe 24 functions as an outlet for the garbage disposal unit 14. The interior chamber 20 houses a grinder assembly 26, which includes a first set of teeth 28 fixedly attached to the wall 22, and a second set of teeth 30 attached to a grinder wheel 32. The grinder wheel 32, which is rotated by a motor 34, also includes a plurality of paddles 36, which propel food debris against the wall 22.

Other garbage disposal units are also known to those skilled in the art. What they all have in common, however, is a cylindrical disposal chamber and a grinder assembly. Furthermore, and referring to FIGS. 1 and 2 of this case, the garbage disposal unit 12 also generally is comprised of a cylindrical neck 14, and an opening 16 which is generally partially covered by a multiplicity of elastomeric flaps 18 and 20. The function of these elastomeric flaps is to prevent garbage particles from being thrown up into the sink 22 (see FIG. 1) from the garbage disposal 12 while simultaneously allowing fluid from faucet 24 to pass into the garbage disposal 12 via passageway 26. Most garbage disposals utilize at least about 4 such elastomeric flaps for this purpose. Many use at least about 6, and more preferably at least about 8, of such elastomeric flaps.

The device 10 of this invention is comprised of a aerosol propellant can or container 28 of generally cylindrical shape having a valve 30 mounted thereon.

Any of the valves commonly used in aerosol propellant containers may be used in the container 28. Thus, by way of illustration, and referring to U.S. Pat. No. 4,034,427 of Breznock et al. (the disclosure of which is hereby incorporated by reference into this specification), the valve 30 may be an inverted vertical action valve assembly including a valve stem controlling a valve for delivery of propellant from the container, and means biasing said valve stem to the closed position when no propellant is discharged. Thus, as is disclosed in U.S. Pat. No. 3,823,427 of Pittet (the disclosure of which is hereby incorporated by reference into this specification), the valve 30 may be an inverted, vertical action valve assembly having a large stem orifice which allows for a high delivery rate and multiple applications, said valve assembly being mounted in the end of the container and being of the vertical reciprocation type, such that a force applied to the device results in the discharge of propellant through it.

The aerosol container 28 is preferably comprised of material adapted to be formed into a foam when discharged from the valve 30.

Those skilled in the art are aware of many compositions which are in foam or froth form after being discharged from the valve of an aerosol can. As used in this specification, the term foam refers to a dispersion of a gas in a liquid. The use of a froth or a foam furnishes extended repeated liquid-gas interfaces (see, e.g., U.S. Pat. No. 4,127,383 of Johnston et al., the disclosure of which is hereby incorporated by reference into this specification).

Foam-forming compositions are well known to those skilled in the art. By way of illustration and not limitation, such compositions include those described in U.S. Pat. No. 3,639,568 of Schmitt (which discloses a gas-releasable composition comprised of water-soluble organic solvent and compressible gas), U.S. Pat. No. 4,339,550 of Palinczar et al. (which discloses a foam product comprised of different volatile ingredients), U.S. Pat. No. 4,009,253 of Schleppnik et al. (which discloses that the pentanone compound therein can be used in foams), U.S. Pat. No. 4,622,221 of Schleppnik (which discloses that the cylcohexyl compound therein may be used in foams), and the like. The disclosure of each of these United States patents is hereby incorporated by reference into this specification.

The foam-forming composition within container 28 is comprised of an effective amount of disinfectant. As is known to those skilled in the art, a disinfectant is an agent which disinfects by destroying, neutralizing, or inhibiting the growth of pathogenic microorganisms. Thus, by way of illustration and not limitation, one may use n-alkyl dimethyl benzyl ammonium chlorides wherein the alkyl is higher alkyl of from 10 to about 18 carbon atoms (such as, for example, 68 percent C12 and 32 percent C14). The disinfectant may be present in a composition of from about 0.01 to about 10 weight percent.

The foam composition within container 28 also preferably is comprised of an effective amount of a malodor counteractant. Thus, by way of illustration, one may use any of the malodor counteractants described in the U.S. Pat. Nos. 4,755,377 of Steer, 4,339,550 of Palinczar et al., 4,009,253 of Schleppnik et al., 4,622,221 of Schleppnik, 4,187,251 of Schleppnik, 4,591,497 of Naito et al., and the like. Alternatively, one may use other deodorants such as, e.g., lemon perfume. It is preferred that the foam composition contain from about 0.02 to about 5.0 weight percent of the malodor counteractant.

The foam composition within container 28 is also preferably comprised of an effective amount of detergent such as, e.g., from about 5 to about 20 weight percent (and preferably from about 7 to about 15 weight percent) of detergent. As is known to those skilled in the art, a detergent is used to enhance the cleaning action of water by acting as a wetting agent and emulsifier. The detergent may be anionic (e.g., the sodium salts of medium chain length [7–18 carbons] alkyl sulfates or sulfonates), cationic (e.g., the tetralkyl ammonium halides), or nonionic (e.g., products made from tall oil by reaction with ethylene oxide).

By way of illustration, in one embodiment the material inside container 28 is comprised of from about 1.0 to about 2.5 weight percent of the tetrasodium salt of ethylene diamine tetracetacid, from about 8 to about 10 weight percent of nonylphenoxy polethoxy ethanol, from about 1 to about 2 weight percent of 2-butoxy ethanol, from about 1 to about 2 weight percent of diethylene glycol ethyl ether, from about 0.5 to about 2.0 weight percent of n-alkyl dimethyl benzyl ammonium chloride (wherein the alkyl is higher alkyl containing, for example, 12 carbon atoms and/or 14 carbon atoms), from about 0.05 to about 1.0 weight percent of anhydrous sodium metalsilicate, from about 0.04 to about 0.5 weight percent of sodium nitrite, from about 0.04 to about 0.1 weight percent of morpholine, from about 0.5 to about 2.0 weight percent of lemon perfume, and a sufficient amount of water to bring the materials in the composition (with the exception of propellant) up to 95 parts by weight). Thereafter, the material is mixed with about 5 weight percent of propellant to produce the foamable composition.

Any of the propellants known to those skilled in the art may be used. Thus, for example, one may use a blend of gases including propane, isobutane, n-butane, isopentane, and ethane. The use of this mixture with the aforementioned composition at a weight/weight concentration of 5.0 percent will produce a mixture with a pressure of 46 p.s.i.g.

Referring again to FIG. 1, it will be seen that container 28 is adapted to fit within opening 16 of garbage disposal 12.

Adaptor 32 can be removably attached to the top 34 of container 28 by conventional means.

Figure 2:
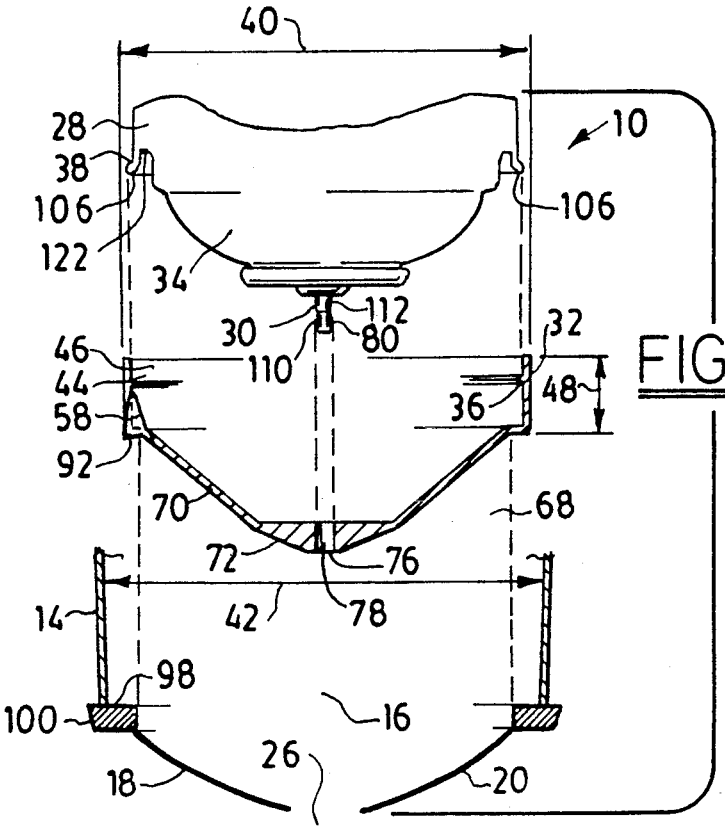
FIG. 2 is a partial sectional view of the top of the cleaning device of FIG. 1, illustrating the cooperation between the adaptor of said device and the aerosol dispenser of said device.

In one embodiment, illustrated in FIG. 2, adaptor 32 is comprised of a horizontally-extending lip 36 which, when adaptor 32 is pressed against the top 34 of container 28, mates with and is secured by chime 38. This mating arrangement is also illustrated in FIG. 2.

The maximum width 40 of adaptor 32 is smaller than the internal diameter 42 of opening 16 of garbage disposal 12. It is preferred that the maximum width 40 of adaptor 32 be from about 80 to about 98 percent of the internal diameter 42 of opening 16 and, more preferably, from about 87 to about 97 percent of internal diameter 42.

Referring again to FIG. 2, it will be seen that, in the preferred embodiment depicted, adaptor 32 is an integral structure which, preferably, consists essentially of plastic and is injection molded. Any of the plastic materials commonly used to make injection molded parts may be used in adaptor 32. Thus, by way of illustration, one may use thermoplastic materials such as, e.g., polyethylene, polypropylene, and the like.

Integral adaptor 32 is comprised of a flange 44. This upwardly-extending rim 44 contains, on its inner surface 46, horizontally-extending lip 36 which, as indicated above, is adapted to mate with chime 38.

The width 48 of rim 44 is sufficient so that, when adaptor 32 is pressed into place onto the top 34 of can 28, the lip 36 contacts and is engaged by the chime 38. In one preferred embodiment, the width 48 of rim 44 is from about 0.3 to about 0.7 inches and, more preferably, from about 0.5 will be seen that, in the to about 0.65 inches.

Referring to FIG. 3, it will be seen that, in the preferred embodiment depicted therein, rim 44 is discontinuous, being formed of a multiplicity of upwardly-extending sections 50, 52, and 54. It is preferred that rim 44 be comprised of at least three such upwardly-extending sections, each of which is separated by a locking device 56, 58, and 60.

Referring again to FIG. 3, it will also be seen that adaptor 32 is preferably comprised of at least three arcuate slots which separate rim 44 (and its sections 50, 52, and 54) from the inwardly-extending portion 68 of adaptor 32.

Referring again to FIG. 2, it will be seen that portion 68 of adaptor 32 is comprised of an inwardly-extending wall 70 which is connected to rim 44. The inwardly-extending wall 70 is adapted to contact and separate elastomeric flaps 18 and 20 when container 28 is pushed in the direction of opening 16.

In the preferred embodiment illustrated in FIG. 2, inwardly-extending section 68 is comprised of both inwardly-extending wall 70 and arcuate section 72. In another embodiment, inwardly-extending section 68 consists essentially of one inwardly-extending wall 70. In both embodiments, however, the bottom 76 of inwardly-extending section 68 terminates in an orifice 78 adapted to receive valve stem 80 of valve 30.

Referring again to FIG. 3, it will be seen that locking devices 56, 58, and 60 are disposed within slots 82, 84, and 86 which are formed between upwardly-extending sections 50, 52, and 54 of rim 44. The slots preferably extend from the outermost edge 88 of rim 44 to point 90, where inwardly-extending portion 68 begins and is integrally joined to rim 44.

The locking devices 56, 58, and 60 are so attached to inwardly-extending section 68 so that such locking devices are free to move within slots 82, 84, and 86 upon the application of a suitable pressure in the appropriate direction.

Referring to FIG. 1, and in the preferred embodiment depicted therein, it will be seen that locking device 56 (as well as locking devices 58 and 60) preferably has a substantially triangular shape and is adapted to contact the top of chime 38 and to mate with a lip formed on said chime. This feature is shown in greater detail in FIG. 6.

Figure 6:
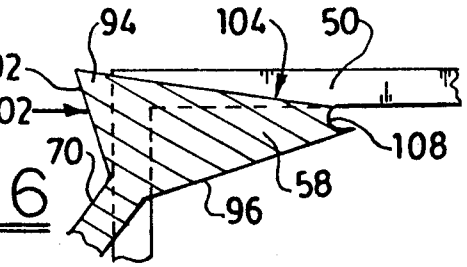
FIG. 6 is a partial sectional view of one portion of the adaptor of FIG. 2.

Referring to FIG. 6, it will be see that locking device 58 is disposed within a slot adjacent to portion 50 or rim 44. Locking device 58 is preferably integrally formed with inwardly-extending wall 70 and, as indicated above, is preferably substantially triangularly shaped. However, as will be realized by those skilled in the art, the shape of locking device 58 is not critical.

Referring again to FIG. 6, it will be seen that the base 92 of locking device 58 forms an acute angle 94 with upwardly-extending wall 96. Thus, referring to FIG. 2, when base 92 of locking device 58 contacts the upper interior surface 98 of base 100, of garbage disposal unit 12, the locking device is pushed inwardly and caused to disengage from chime 38. This is illustrated in FIG. 6, where it will be seen that a force in the direction of arrow 102 will cause locking device to move in the direction of arrow 104.

Referring again to FIG. 2, it will be seen that chime 38 is comprised of downwardly-extending lip 106, which lip is adapted to sit on the top recessed surface 108 (see FIG. 6) of locking device 50.

Figure 5:
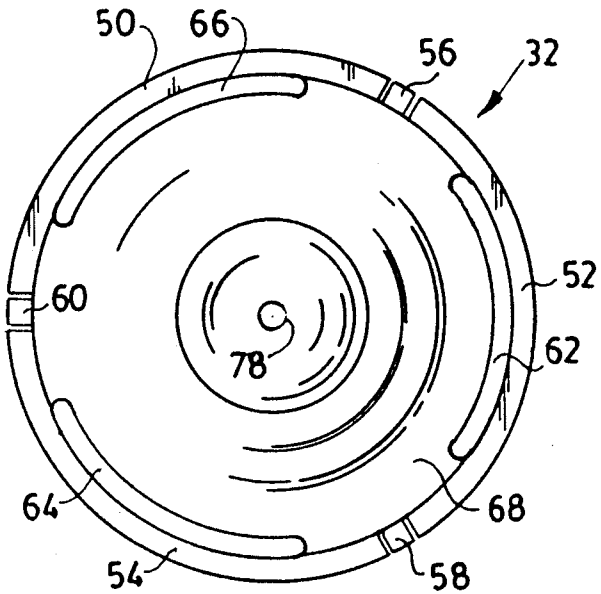
FIG. 5 is a top view of the adaptor of FIG. 2.

FIG. 5 is a top view of adaptor 32.

Figure 7:
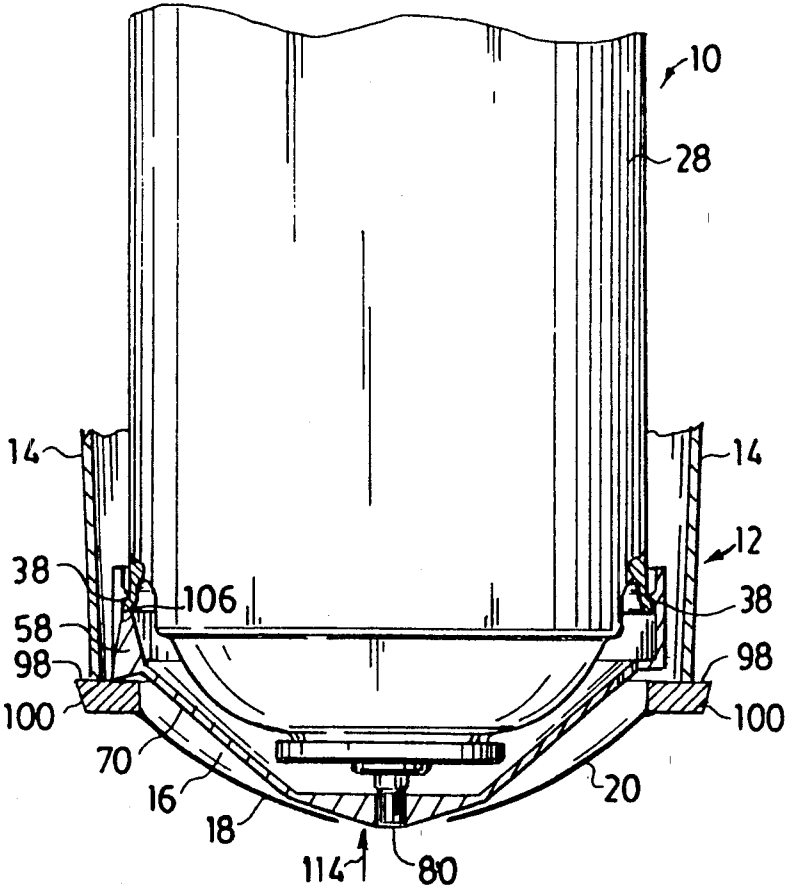
FIG. 7 is a side view of the device of FIG. 1 disposed within a garbage disposal opening prior to the time sufficient pressure has been exerted upon it to cause it to dispense foam.

FIG. 7 illustrates the device 10 when it is disposed within opening 16 and only the force of gravity is urging it in a downward position.

Referring to FIG. 7, it will be seen that, in the position depicted therein, the bottom portion of chime 38 (lip 106) rests within the recessed surface 108 (not shown in FIG. 7, but see FIG. 6) of locking device 58. Although it is not shown in FIG. 7, the lip 106 of chime 38 also will rest in the comparable recessed surfaces 108 (not shown) of locking devices 56 and 60.

Orifice 78 and valve stem 80 are so dimensioned that, when valve stem 80 is pushed against orifice 78, it cannot go completely through it. Any conventional means may be used to achieve this result.

In one embodiment, not shown, valve stem 80 has a diameter larger than that of orifice 78. In another embodiment, illustrated in FIG. 2, valve stem 80 is comprised of a relatively narrow portion 110 and a relatively wide portion 112. Although the narrow portion 110 is adapted to fit within orifice 78, the wide portion 112 is not.

Figure 8:
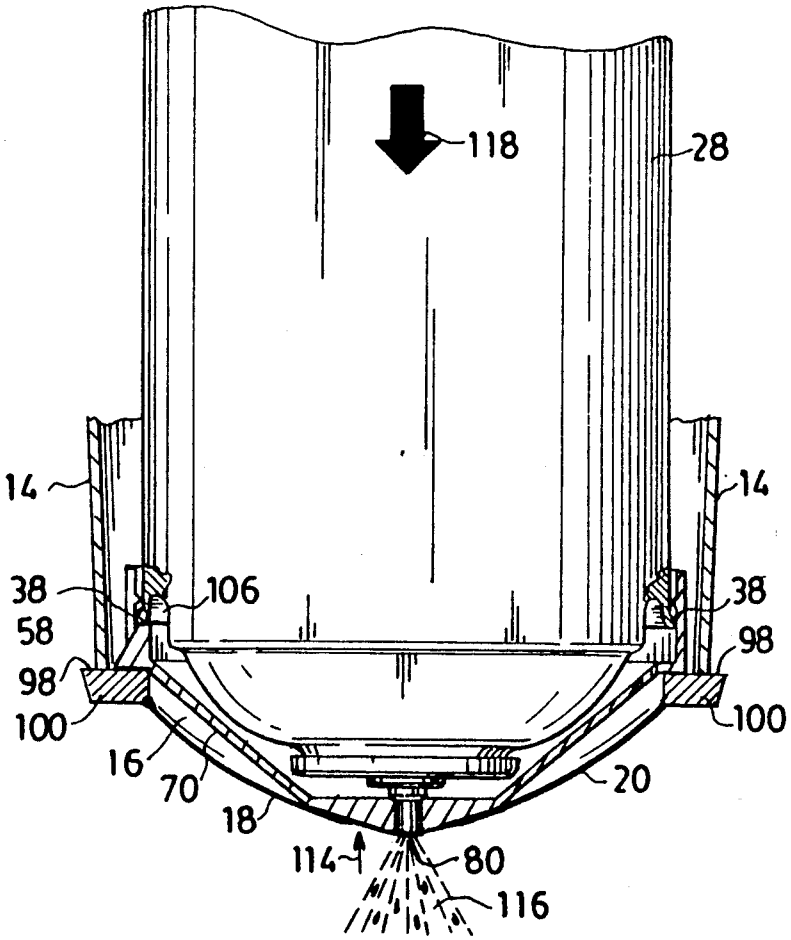
FIG. 8 is a side view of the device of FIG. 1 disposed within a garbage disposal opening after sufficient pressure has been exerted upon it to cause it to dispense foam.

Referring again to FIG. 7, and in the embodiment depicted therein, the valve stem 80 is disposed within the orifice 78 in such a manner that no force is exerted on valve stem 80 in the direction of arrow 114. By comparison, in the embodiment illustrated in FIG. 8, force has been exerted on valve stem 80 in the direction of arrow 114, causing foam contents 116 to be dispensed from the device.

In the embodiment depicted in FIG. 7, the force of gravity acting upon device 10 is not sufficient to dislodge lip 106 from recessed surface 108 of the locking devices. By comparison, in the embodiment depicted in FIG. 8, when force is applied by a user of device 10 in the direction of arrow 118, the locking devices are dislodged from the surface 106 of chime 38.

The cause of this dislodgement is illustrated in FIG. 6. Referring to FIG. 6, the pressure on container 28 in the direction of arrow 118 (see FIG. 8) forces base 92 of locking device 58 to move in the direction of arrow 102, causes the locking device 58 (and the other locking devices 56 and 60) to move in the direction of arrow 104 and thereby to be dislodged from chime 38, and thus allows the container 28 to move from its locked position (see FIG. 7) to its unlocked position (see FIG. 8), to compress the valve stem 78, and to cause foam material 116 to be discharged into the garbage disposal unit 12.

The device 10 also contains a means for causing it to resume its locked position of FIG. 7 once the manual pressure in the direction of arrow 118 is released. Without wishing to be bound to any particular theory, applicant believes that, once the manual pressure has been released, the force caused by the escaping foam 116 causes the container 28 to move in the direction of arrow 114 and thereby resume its locking position of FIG. 7.

In one embodiment, illustrated in FIGS. 9, 10, 11, and 12, device 10 is comprised of an overcap 120 which is adapted to fit within arcuate slots 62, 64, and 66 (see FIGS. 3 and 5). This overcap 120 is configured so that it can fit within said arcuate slots and rest within a groove defined by chime 38.

Figure 12:
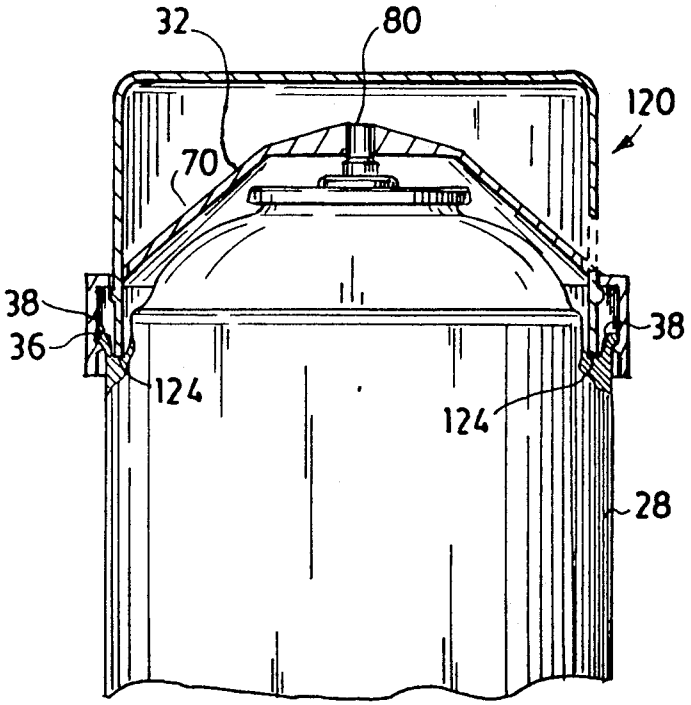
FIGS. 9, 10, 11, and 12 illustrate one preferred embodiment of applicant's cleaning device.

Referring to FIG. 2, it will be seen that chime 38, which extends around the perimeter of container 28, defines an arcuate groove 122. Referring to FIG. 12, it will be seen that the bottom portion 124 of overcap 120, after extending through the arcuate slots in adaptor 32, rest within arcuate groove 122.

Referring again to FIG. 9, it will be seen that overcap 120 is comprised of a multiplicity of cutout sections 126 and 128. Thus, in this embodiment, the bottom portion 130 of overcap 120 is comprised of cutout portion 126, downwardly-extending lip 132, cutout portion 128, another downwardly extending lip (not shown), a third cutout portion (now shown), and a third downwardly-extending lip (not shown). The downwardly-extending lips are adapted to fit within the arcuate slots 62, 64, and 66.

Figure 9:
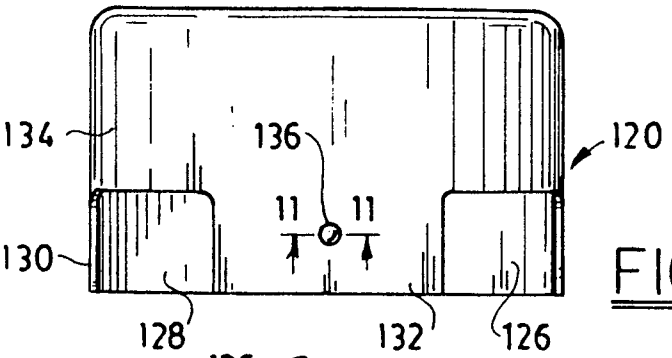
Figure 10:
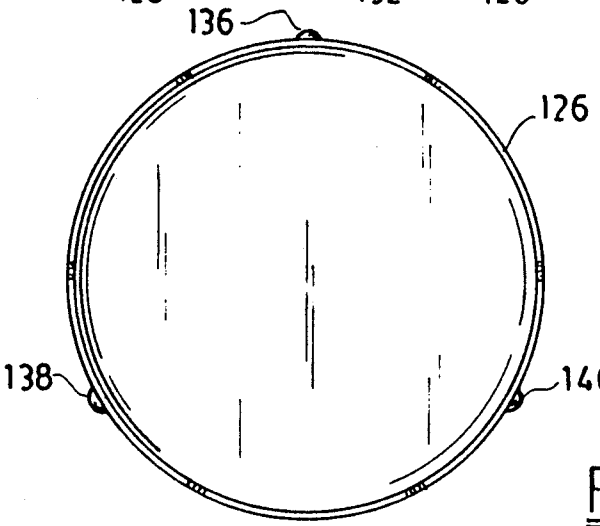
Figure 11:
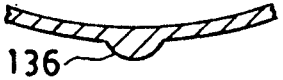

In the preferred embodiment illustrated in FIGS. 9, 10, and 11, outwardly-extending dimples on the exterior surface 134 of overcap 120 tend to assist in removably securing overcap 120 within the arcuate slots. One such dimple, dimple 136, is shown in FIGS. 9 and 11. The other two dimples 138 and 140 are illustrated in FIG. 10.

Use of Device 10

It is preferred to use the device 10 in accordance with the following process. The overcap 120 (see FIG. 12) should first be removed. Thereafter, device 10 should be shaken well. Thereafter, the device 10 should be turned upside down and placed in the opening of a sink or disposal. Thereafter, one should press down on device 10 for about two seconds to discharge material from it; and then pressure should be released. The can should be removed from the sink/disposal opening, and excess material discharged from the device 10 should be wiped from the applicator. Thereafter, the material discharged into the opening should be allowed to sit in the opening for a period of, e.g., from about 10–15 minutes prior to the time water is run and/or the disposal is run.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A process for treating a garbage disposal unit comprised of an inlet, comprising the steps of:

(a) providing a spraying device, wherein said device is comprised of an aerosol propellant container of substantially cylindrical shape and a substantially cylindrical adaptor removably attached to said container, and wherein:

1. said aerosol propellant container is comprised of an inverted vertical action valve comprising a valve stem and a foam-forming composition and propellant;
2. said substantially cylindrical adaptor is comprised of a top rim section and, integrally joined to said top rim section, a downwardly and inwardly extending bottom section, wherein:
   (a) the bottom portion of said downwardly and inwardly extending bottom section is comprised of an orifice;
   (b) said top rim section is comprised of three upwardly-extending flange sections wherein each of said upwardly-extending flange sections is separated from an adjacent flange section by an vertically-extending slot, and wherein:
      1. each of said upwardly-extending flange sections is attached to a portion of said downwardly and inwardly-extending bottom section,
      2. at least a portion of each of said upwardly-extending flange sections is separated from said downwardly and inwardly extending bottom section by a substantially horizontally-extending arcuate slot, and
      3. a vertically-extending movable tab is disposed within each of said vertically-extending slots, and said movable tab is attached to said downwardly and inwardly extending bottom section;

(b) disposing said spraying device within said inlet to said garbage disposal unit such that said substantially cylindrical adaptor extends downwardly into said inlet; and (c) applying pressure to said aerosol propellant container, moving each said vertically-extending movable tab inwardly within each said vertically-extending slot, and moving said inverted vertical action valve upwardly, thereby discharging material into said inlet.

2. The process as recited in claim 1, wherein said aerosol propellant container is comprised of an upwardly extending chime on the top portion of said container.

3. The process as recited in claim 1, wherein said downwardly and inwardly extending bottom section is formed by a substantially linear downwardly and inwardly extending side section which is integrally joined to a substantially arcuate section.

4. The process as recited in claim 1, wherein each of said vertical-extending movable tabs is substantially triangularly shaped.

5. The process as recited in claim 4, wherein each of said vertically-extending movable tabs is comprised of a recessed, arcuate section.

6. The process as recited in claim 1, wherein said spraying device is comprised of a substantially cylindrical overcap, and wherein said overcap is comprised of a multiplicity of cutout sections.

7. The process as recited in claim 8, wherein said spraying device is comprised of a multiplicity of outwardly-extending dimples attached to the outer surface of said overcap.

* * * * *